US010420697B2

(12) United States Patent
Zhu et al.

(10) Patent No.: US 10,420,697 B2
(45) Date of Patent: Sep. 24, 2019

(54) DEVICE FOR ASSISTING NAVIGATION

(71) Applicant: Hong Kong R&D Centre for Logistics and Supply Chain Management Enabling Technologies Limited, Pok Fu Lam (HK)

(72) Inventors: Hailong Zhu, Pok Fu Lam (HK); Feng Lu, Pok Fu Lam (HK); Guangbo Li, Pok Fu Lam (HK); Xiaosheng Chen, Pok Fu Lam (HK); Chilun Mak, Pok Fu Lam (HK); Jiankun Su, Pok Fu Lam (HK); Tingwen Xiong, Pok Fu Lam (HK)

(73) Assignee: HONG KONG R&D CENTRE FOR LOGISTICS AND SUPPLY CHAI, Pok Fu Lam (HK)

( * ) Notice: Subject to any disclaimer, the term of this patent is extended or adjusted under 35 U.S.C. 154(b) by 0 days.

(21) Appl. No.: 15/537,535

(22) PCT Filed: Dec. 19, 2014

(86) PCT No.: PCT/CN2014/094390
§ 371 (c)(1),
(2) Date: Jun. 19, 2017

(87) PCT Pub. No.: WO2016/095212
PCT Pub. Date: Jun. 23, 2016

(65) Prior Publication Data

US 2017/0354566 A1 Dec. 14, 2017

(51) Int. Cl.
*A61H 3/06* (2006.01)
*A45B 3/00* (2006.01)
(Continued)

(52) U.S. Cl.
CPC ..... *A61H 3/068* (2013.01); *A45B 3/00* (2013.01); *A61H 3/061* (2013.01);
(Continued)

(58) Field of Classification Search
CPC .... A61H 2201/5097; A61H 2201/0107; A61H 2201/5012; A61H 2201/5064; A61H 3/06;
(Continued)

(56) References Cited

U.S. PATENT DOCUMENTS 3,546,467 A * 12/1970 Benham ..... A45B 3/00 135/65
8,627,839 B1 * 1/2014 Martinez ..... A45B 3/00 135/66
(Continued)

FOREIGN PATENT DOCUMENTS

CN 102218008 A 10/2011
CN 202366117 U 8/2012
(Continued)

*Primary Examiner* — Edwin C Holloway, III
(74) *Attorney, Agent, or Firm* — Renner Kenner Greive Bobak Taylor & Weber

(57) ABSTRACT

A device for assisting navigation including a body defining a middle portion having a first end and a second end, a handle portion at one of the first or second ends, a holder that is removably mounted with another end of the first or second ends of the body.

20 Claims, 6 Drawing Sheets

(51) Int. Cl.

| | |
|---|---|
| ***H01Q 1/22*** | (2006.01) |
| ***H01Q 1/38*** | (2006.01) |
| ***H01Q 1/44*** | (2006.01) |
| ***H01Q 9/06*** | (2006.01) |
| ***H01Q 9/26*** | (2006.01) |

(52) U.S. Cl.
CPC ..... *H01Q 1/2225* (2013.01); *H01Q 1/38* (2013.01); *H01Q 1/44* (2013.01); *H01Q 9/065* (2013.01); *H01Q 9/26* (2013.01); *A61H 2003/063* (2013.01); *A61H 2201/0107* (2013.01); *A61H 2201/5012* (2013.01); *A61H 2201/5097* (2013.01)

(58) Field of Classification Search
CPC ..... A61H 3/068; A61H 3/061; A61H 3/066; A61H 2003/063; A61H 2201/5015; A45B 3/00; H01Q 1/2225; H01Q 1/38; H01Q 1/44; H01Q 9/065; H01Q 9/26
USPC ..... 340/4.11
See application file for complete search history.

(56) References Cited

U.S. PATENT DOCUMENTS

| | | | | |
|---|---|---|---|---|
| 2004/0060587 | A1* | 4/2004 | Morosini | A45B 3/02 135/66 |
| 2009/0032590 | A1* | 2/2009 | Hopkins | A61H 3/061 235/385 |
| 2012/0050114 | A1* | 3/2012 | Li | H01Q 1/2266 343/702 |
| 2013/0200992 | A1 | 8/2013 | Kim | |
| 2013/0332018 | A1* | 12/2013 | Kim | G05D 1/0238 701/22 |

FOREIGN PATENT DOCUMENTS

| | | | |
|---|---|---|---|
| CN | 202909043 | U | 5/2013 |
| CN | 203885809 | U | 10/2014 |
| KR | 20090020857 | A | 2/2009 |
| WO | 2005071597 | A1 | 8/2005 |

* cited by examiner

DEVICE FOR ASSISTING NAVIGATION

TECHNICAL FIELD

The present invention relates to a device for assisting navigation and particularly, although not exclusively, to a walking stick comprising a near field communication equipment.

BACKGROUND

A walking stick is commonly used for a variety of reasons and activities. Trekkers may use a walking stick in order to ease navigating in complex terrains such as in forests or trails. A person (such as a visually impaired person) may use a walking stick to simply ease commuting around obstacles, whilst some users may use a walking stick for aesthetic reasons such as to emulate the appearance of a statesman or "Mr Peanut".

Typically, a walking stick is only made of a piece of rigid material and it only assists a user to navigate by providing physical supports. A visually impaired user relies on using the walking stick to make physical contact with a surface (e.g. tactile paving) to obtain relevant information. These may also be known as a "white cane" or a cane for the visually impaired. Despite their widespread uses, these designs may be ineffective and sometimes dangerous for assisting a visually impaired person to navigate as they only offer limited navigational assistance.

SUMMARY OF THE INVENTION

In accordance with a first aspect of the invention there is provided a device for assisting navigation comprising a body defining a middle portion having a first end and a second end, a handle portion at one of the first or second ends, a holder that is removably mounted with another end of the first or second ends of the body, and a communication module that can facilitate wireless or wire transmission of data.

The device for assisting navigation in accordance with a first aspect is advantageous as it is useful to provide support for a user during navigation.

In an embodiment of the first aspect, the holder further comprises a RFID device, a power source and a notification device.

In an embodiment of the first aspect, the RFID device is disposed in the holder along with the power source and at least one notification device.

In an embodiment of the first aspect, the RFID device further comprises a hybrid antenna design that includes at least two jointed antenna structure.

In an embodiment of the first aspect, the at least two jointed antenna structures comprises at least one solid antenna structure and at least one flexible antenna structure connected with the at least one solid antenna structure.

In an embodiment of the first aspect, the power source is a battery, a power socket or a self-sustained power unit.

In an embodiment of the first aspect, the notification device is a haptic feedback generator, an aural feedback generator or a visual feedback generator.

In an embodiment of the first aspect, the RFID device may be configured to interact with the communication module separately from the notification device, or the RFID device may be configured to interact with both the communication module and the notification.

In an embodiment of the first aspect, the communication module may receive a different format of data other than the notification device's received data.

In an embodiment of the first aspect, a user may connect at least one equipment with the communication module so as to interpret the different format of data external of the device for assisting navigation.

In an embodiment of the first aspect, the body is an elongated hollow structure.

In an embodiment of the first aspect, one of the first or second ends further comprises a mounting portion that mounts the holder with the body.

In an embodiment of the first aspect, the mounting portion further comprises an attachment mechanism that connects with a portion of the holder.

In an embodiment of the first aspect, the attachment mechanism is a lock having a resilient portion, a stopper portion, an engagement portion and an extension.

In an embodiment of the first aspect, the handle portion is a layer of texturised material.

In an embodiment of the first aspect, the handle portion further comprises a storage solution.

In accordance with a second aspect of this invention, there is provided a method of navigating within a space distributed with RFID tags, the method comprises removably attaching a RFID reader with a walking assistance such as a cane, the RFID reader communicates with RFID tags and at least one notification device connecting with the RFID reader generating a signal through notification device regarding information stored on the RFID tags.

In accordance with a third aspect of this invention, there is provided another method of navigating within a space distributed with RFID tags, the method comprises removing a RFID reader from a walking assistance such as a cane, the RFID reader communicates with RFID tags and at least one notification device connecting with the RFID reader generating a signal through notification device regarding information stored on the RFID tags.

In accordance with a fourth aspect of this invention, there is provided another method of navigating within a space distributed with RFID tags, the method comprises removably attaching a RFID reader with a walking assistance such as a cane, the RFID reader communicates with RFID tags and at least one communication module connected with an equipment external of the walking assistance, the equipment is capable of interpreting data received into a human understandable format regarding information stored on the RFID tags.

In accordance with a fifth aspect of this invention, there is provided another method of navigating within a space distributed with RFID tags, the method comprises removing a RFID reader with a walking assistance such as a cane, the RFID reader communicates with RFID tags and at least one communication module connected with an equipment external of the walking assistance, the equipment is capable of interpreting data received into a human understandable format regarding information stored on the RFID tags.

Further aspects will become apparent to the skilled person from the description and appended claims which are given by the way of example only to illustrate one or more embodiments of the invention.

BRIEF DESCRIPTION OF THE DRAWINGS

Embodiments of the present invention will now be described, by way of example, with reference to the accompanying drawings in which.

DETAILED DESCRIPTION OF THE PREFERRED EMBODIMENT

The following description is given by way of example only to illustrate preferred embodiments of the invention. In particular, the language and terminology used herein is for descriptive purposes only and is not intended to limit the scope or functionality of the invention. The invention may be employed in various combinations or embodiments utilizing various elements and means not explicitly described herein, but within the knowledge and skill of one ordinarily skilled in the art.

Figure 1:
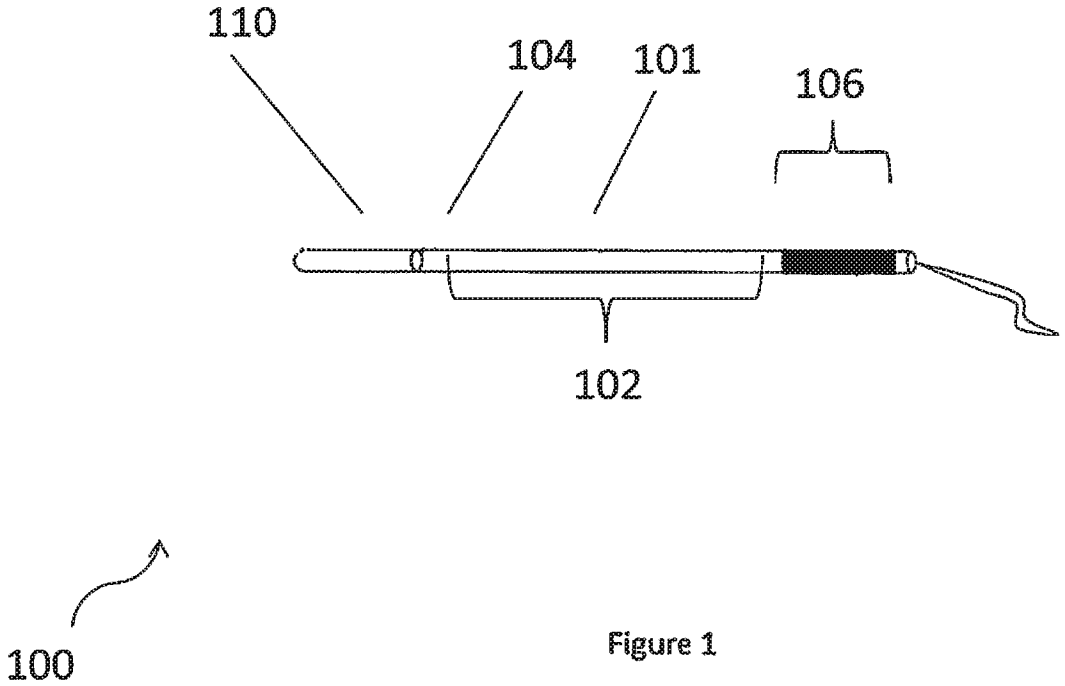
FIG. 1 is an overall view of a device for assisting navigation in accordance with one embodiment of the present invention.

With reference to FIG. 1, there is shown a device for assisting navigation in accordance with the present invention comprising a body defining a middle portion having a first end and a second end, a handle portion at one of the first or second ends, a holder that is removably mounted with another end of the first or second ends of the body, and a communication module that can facilitate wireless or wire transmission of data.

In this embodiment as shown in FIG. 1, the device for assisting navigation is arranged to operate as a walking stick 100 that has a body 101 defining a middle portion 102 that has a first end 104 and second end 106. Such a device can be used by a user to provide extra support during movement in order to avoid falling or to assist the user with navigating different areas. For example, a trekker may use a walking stick to assist his/her movement in difficult terrains or a visually impaired person may use the walking stick to assist with navigating around obst.

In this embodiment, the body 101 of the walking stick 100 is made with an elongated circular hollow tube but it can also be made from a solid material or having other cross sections. The body 101 can be made of different materials but preferably a material that is light, resilient and corrosion resistance such as aluminium or composite material such as carbon fibre reinforced plastic (CFRP) is preferred. Aluminium is also a very suitable material for a walking stick as it is strong and (relatively) lightweight.

It is also corrosion resistant and it may be recycled so as to reduce waste. However, aluminium may not be suitable for certain applications such as sport activities and for elderly's use. For these applications where lightness and strength is the most important attributes, CFRP may be used instead due to its extremely high strength to weight ratio.

The middle portion 102 defined by the body 101 may include a first end 104 and a second end 106. In this example the body 101 further includes a handle portion at either one of the first or second ends 104,106, which the handle portion may be a region on the body 101 that is covered by a layer of texturised material. In another embodiment the handle portion can be a detachable part that is connected with one of the first or second ends 104,106 of the middle section 102 through attaching methods such as magnets or screw threading.

Preferably, the handle portion 101 is made from a layer of texturised material such as molded plastic which has an ergonomic shape conforming to a hand. Alternatively, the handle portion 101 may be made from a layer of soft rubber for improved comfort when holding the handle. In another embodiment the handle may be a detachable portion that can be attached to one of the first 104 or second 106 ends of the body.

Figure 2:
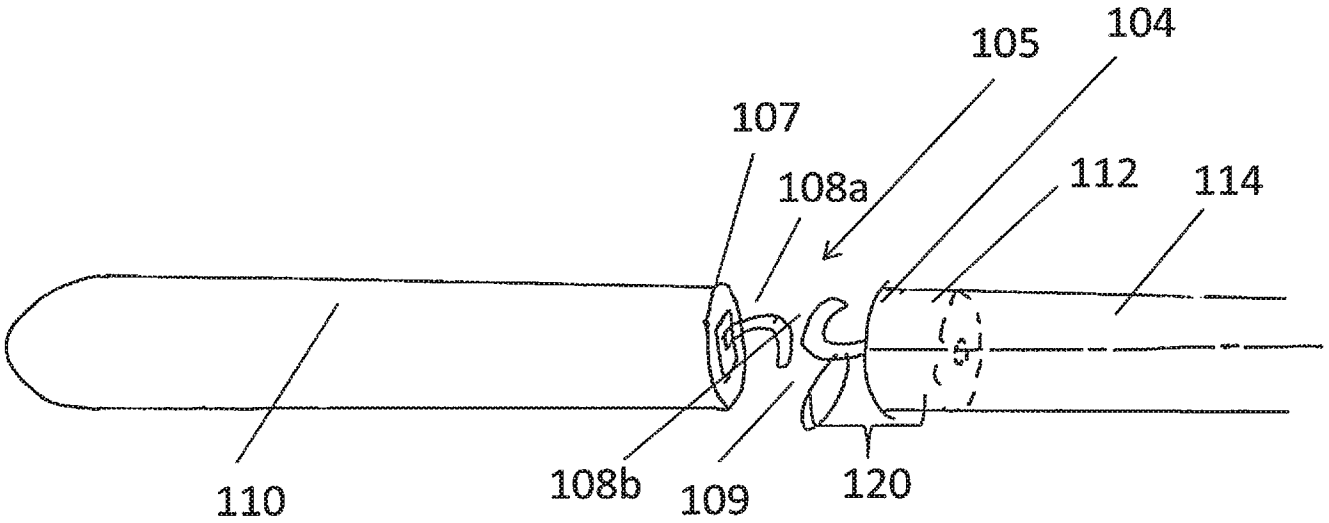
FIG. 2 is an exploded view of the device for assisting navigation's of FIG. 1.

In this embodiment, the walking stick 100 further includes a holder 110 that is removably mounted with another end of the first or second ends 104,106 of the body 101 opposite the middle portion 102. The holder 110 preferably has a generally the same cross section as the walking stick 100 for aesthetic reasons but it can be formed with a different profile. The holder 110 may also be a hollow structure that has a closed end for concealing objects within the cavity. The holder may also be made of the same material as the walking stick 100 such as composite material or metallic material. In the embodiment as shown in FIG. 2 the holder 110 is removably mounted with the first end 104 of the walking stick 100. In this example, the holder 110 has a cap 107 located at a proximal end adjacent the first end 104 of the walking stick 100. The cap 107 of the holder 110 further includes a first locking device 105 shown here made of interacting hooks. In the embodiment shown, a first hook 108*a* forms part of the locking device, and, at the first end 104 of the walking stick 100 there is a corresponding second hook 108*b* forming part of the locking device. The cap 107 of the holder 110 is secured on the holder through the use of traditional securing means such as screw threads or notches. A person skilled in the art would appreciate that the selection of locking device and securing means is subjected to variation as different designs are beneficial for different applications. For example, a walking stick that is sold in a region subjected to large amount of rainfall may choose to have water-proof securing means whereas such is not necessary for walking sticks marketed in arid regions.

The second hook 108*b* of the body 101 is mounted with the body through an elastic member, which in this preferred embodiment is a piece of elastic string 114 that is housed within the hollow tube of the body. The string 114 provides a pulling force for coupling the holder 110 with the body 101. Due to the retractable nature of the string 114, the second hook 108*b* will be pulled to an extent where it will be difficult for a user to access and therefore a combination of means are also incorporated in this embodiment in order to prevent the hook from being inaccessible should it be retracted into the hollow body due to the pulling force of the elastic string.

As shown in FIG. 2, a catch 112 is being incorporated into the cavity of the hollow body 101 and the catch has an aperture that is larger than the diameter of the string 114 but smaller than the size of the second hook 108*b*. In addition to the catch 112, a user operable portion 109 is also integrally formed with the second hook 108*b* so a user can have easy access to pulling the hook out of the cavity of the body 101 for coupling the first hook 108*a* of the holder 110. The user operable portion 109 in this preferred embodiment is an extension cord that is made of fibres and it is elastic to a certain degree. However, in other embodiments a different component maybe used instead and they can be small chain for added durability or a rigid rod.

Figure 3:
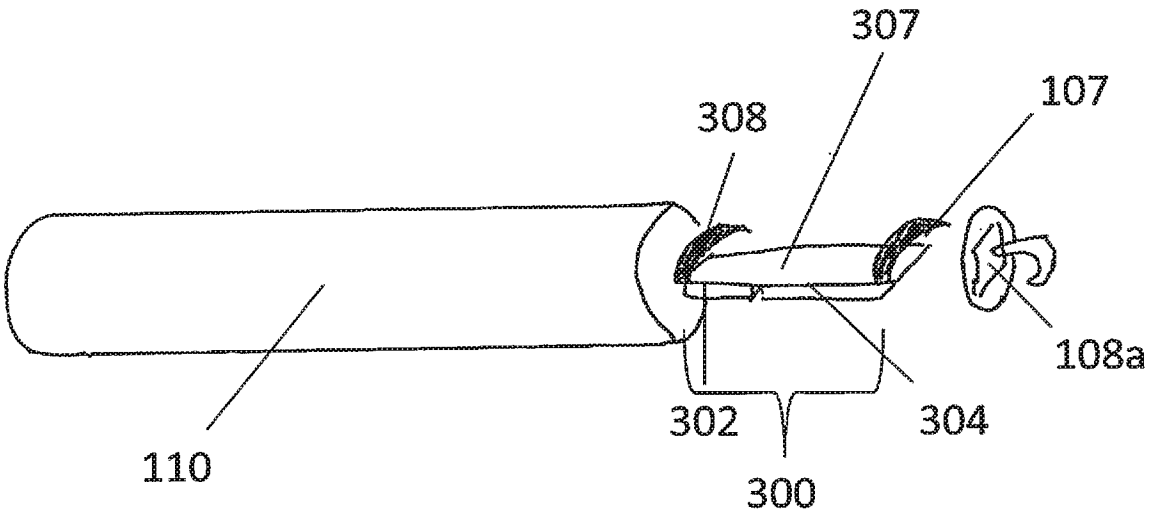
FIG. 3 is an exploded view of the holder of FIG. 1.

The holder 110 that is coupled to the first end 104 of the body 101 also includes an internal storage space formed for holding an electrical member. In this embodiment as shown in FIG. 3, the holder houses a RFID device 300 that is consisting of a power supply 302, a notification device and a hybrid antenna design 300. In another embodiment that is not shown, the RFID device may be connected with a communication module instead, or the RFID device may be connected with both of the communication module and the notification device.

Figure 6:
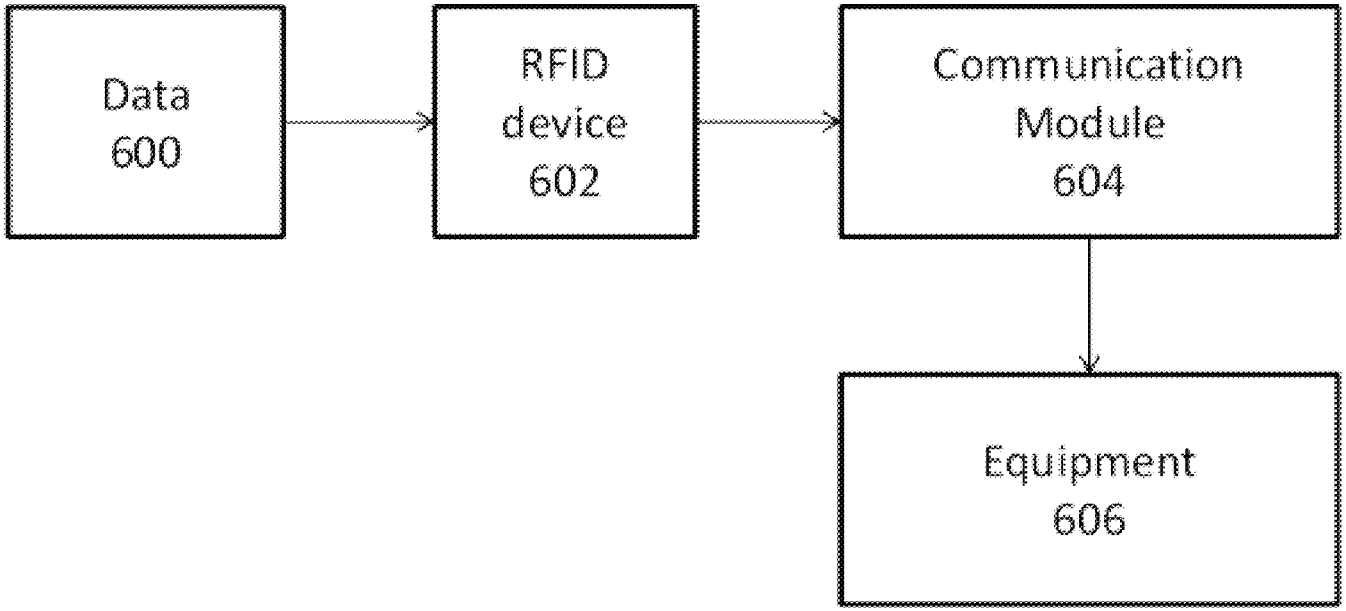

Referring to FIG. 6, a user may use a RFID device 602 to obtain data 600 from a device such as, but not limited to a (powered, non-powered or semi-powered) RFID tag. Once the data 600 is obtained, the RFID device 602 may transmit the (raw or processed) data 600 to a communication module 604. The communication module 604 may be a physical interface such as a USB interface or an Ethernet interface. The communication module 604 may also be a wireless interface such as Bluetooth or WiFi. The communication module 604 may then transmit the data 600 to equipment 606 that may not be part of the device 100 or may be part of the device 100. For example, the equipment 606 may be a tablet computer, a smart phone or even a receiver having processing power such as a wireless headset or "smart glasses" such as Google Glass. A user may then interpret the data 600 that is processed by the equipment 606 as opposed to be a notification device (not shown) for only a simply readout of the data 600. The advantages of such a configuration is that firstly, the as the raw data 600 may require sophisticated or proprietary software or algorithm to interpret, the security of the information (i.e. data 600) is greatly enhanced. Secondly, a more comprehensive interpretation of the data 600 may be realized through using a more complex system (i.e. equipment 606).

For instance, the equipment may include analytical tool (e.g. algorithm or software) that can complement the data 600 with predetermined information in order to enrich a user's interpretation of the data 600 as opposed to a simple feedback (e.g. haptic feed such as a series of vibration) generated by a notification device.

In this embodiment, the device 100 includes a power supply 302 mounted with the holder 110 is responsible for supplying necessary power to energise the RFID device 300 for communication with another RFID element. The power supply 302 is in this embodiment is a rechargeable battery (e.g. Lithium-ion battery). The power supply 302 in other embodiments can be a non-rechargeable battery or even a small generator such as a piezoelectric generator.

A RFID device 300 can be used to access certain information that is separately stored on another element and such a device is greatly beneficial to the device 100. For example, a user may carry a RFID tag that contains a unique identifier that can be accessed by a RFID reader for personal identification.

In another example, the RFID device 300 carried by a user can also be a powered device that can interact with another powered RFID device 300 for data exchange, such as mobile payment or personal identification with enhanced security measure. In yet another example, a user may use a powered RFID device 300 to interact with other RFID elements (e.g. non-powered or semi-powered tags) so as to use the RFID device 300 to obtain information from differently located RFID elements. To elaborate, a user may use a reader that has certain feedback generating components to obtain data from a RFID tag and convert the stored data into a an interpretable information through means of such as a display or a speaker.

In a preferred example, the RFID device 300 carried by a user may be connected with a communication module. The communication module may be configured to receive a same type of data (format) as the notification device, or the communication module may receive a different type of data (format) other than a notification device. The device 100 may be designed to include only the communication module or both of the communication module and the notification device.

It is beneficiary to configure the device 100 to include the communication module to connect with a RFID device 300. The communication module may transmit a raw unprocessed RFID data read from another RFID device such as a RFID tag, and then the data may be transmitted to equipment external or internal of the device 100. Such equipment external of the device 100 includes a tablet, a smart phone or a dedicated reader that may run a version of software for interpreting RAW unprocessed RFID data into human understandable format.

In one particular example, a visually impaired person may use a walking stick comprising a RFID device 300 for assisting navigation in a train station. The train station may be deployed with a plurality of RFID tags near the edge of a platform so when a user walks towards to edge for queuing to board a train, the RFID device 300 of the walking stick will detect the RFID tags near the edge of the platform and generate a signal to the user to warn him/her regarding safety hazards of walking into the platform through the notification.

In another example, a visually impaired person may use a walking stick comprising a RFID device 300 for assisting navigation in a train station. The train station may be deployed with a plurality of powered RFID tags that are constantly updated with information regarding for example updates of train schedules due to unexpected occurrences. The visually impaired person may put on equipment such as a Bluetooth headset that is wirelessly connected with the communication module that is connected with the RFID device. When the visually impaired person uses the RFID device to obtain data from the powered RFID tag, the Bluetooth headset may be able to generate a playback of sound that can be in the form of an announcement made by a pre-recorded bank of sound. Such a system is very advantageous to a visually impaired person as he/she may now have a better idea of the latest update regarding the train service.

In yet another example, the RFID device 300 of the walking stick may have mobile payment capability and a visually impaired person can detach the holder portion that is containing the RFID device 300 for payment at different locations that support the use of mobile payment (as opposed to cash payment). Such a design is advantageous as it will drastically reduce theft regarding the user's asset as it is significantly harder to detach the holder portion from the walking stick than to pickpocket.

However, the abovementioned examples are only indicative of how RFID elements can be utilised and they are not in any ways limiting other usages of RFID elements that may be used for the current inventions.

Figure 4:
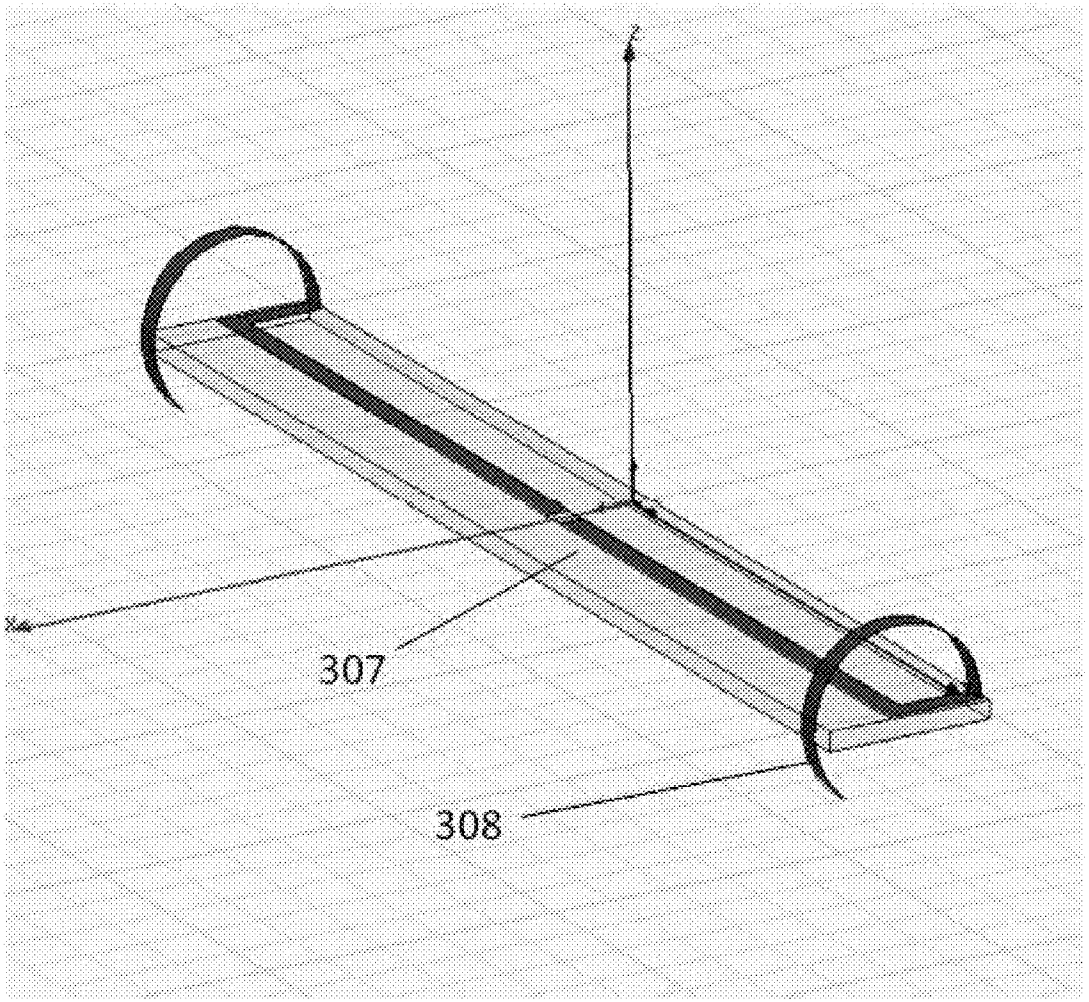
FIG. 4 is a perspective view of the RFID antenna of FIG. 1.

In this embodiment, the power supply 302 is connected with the hybrid antenna design 300 and a notification device 304. The hybrid antenna design 300 may include at least two antenna structures and in this embodiment the hybrid antenna design 300 includes three separate antenna structures of different materials integrally forming a single antenna. As shown in FIGS. 3 and 4, there is a rigid printed circuit board (PCB) 306 coupled with a flexible PCB 308 on each ends of the rigid PCB. The flexible PCB 308 has a resilient characteristic and it can conform to the inner dimension of a cavity without adversely affecting the performance of the antenna radiation.

In order to integrally form the hybrid antenna design 300 for using with the walking stick of the current invention, the hybrid antenna design 300 of this embodiment may include a pair of flexible PCB 308 that are securely connected with a respective location on a rigid PCB 307. As shown in FIG. 3 each of the flexible PCB 308 is attached to a respective end on the rigid PCB 307. In order to securely attach the PCBs together, the flexible PCB may be bolted to the rigid PCB by using screws or other mechanical fastening means such as welding. Alternatively, the flexible PCB may be attached to the rigid PCB through chemical means such as adhesives for gluing the flexible PCBs to the Right PCB or the flexible PCB can be mechanically formed with the rigid PCB by means of 3D printing or any manufacturing technologies that allow such a design.

In another embodiment (not shown), a different antenna design may be used as opposed to the hybrid antenna design. For example a dipole antenna or a patch antenna is also suitable for communication purpose of a RFID element.

In addition to the possible variation of antenna designs, the hybrid antenna design 300 may also subjected to change of material. For example, in this embodiment the hybrid antenna design 300 may use printed circuit boards of rigid and flexible characteristics for construction. However, in another embodiment other conductive materials may be used instead and the electrical conductive materials include metallic materials such as copper or silver. Alternatively, semiconductors such as silicon carbide may also be used for the hybrid antenna design's construction. Also, as the hybrid antenna design 300 may include different antenna structures, the antenna structures may also be made of different materials resulting in a hybrid antenna design 300 that includes alternating combinations of the above mentioned materials.

The hybrid antenna design 300 is also connected with a notification device 304 for data exchange and conveyance of the information stored on a RFID element to a user. The notification device 304 may be a feedback generator that can produce haptic, aural and/or visual feedbacks. For example, a user may use the RFID device 300 in the holder 110 to "read" (i.e. obtain data from) a RFID element and a visual feedback generator of the notification device 304 may produce a light that shows respective information for that user. In the case of a visually impaired user, the notification device 304 may include an aural feedback generator together with a haptic feedback generator.

For example, when the visually impaired user uses a RFID element to interact with a RFID element, the RFID element may include a bank of data and the RFID element that the user is carrying may include a specific set of predetermined rules (that are specific to a user) and it will only read certain information depending on the predetermined rules. If the RFID element contains relevant information to the user and therefore meaningful to the user's RFID element, the user's RFID element may generate certain feedbacks including producing a tone through the aural feedback generator together with movements generated by the haptic feedback generator. Alternatively, if the data is not relevant to the user, the feedback generators may not operate at all or a different combination of feedbacks may be generated to acknowledge the user.

Figure 5:
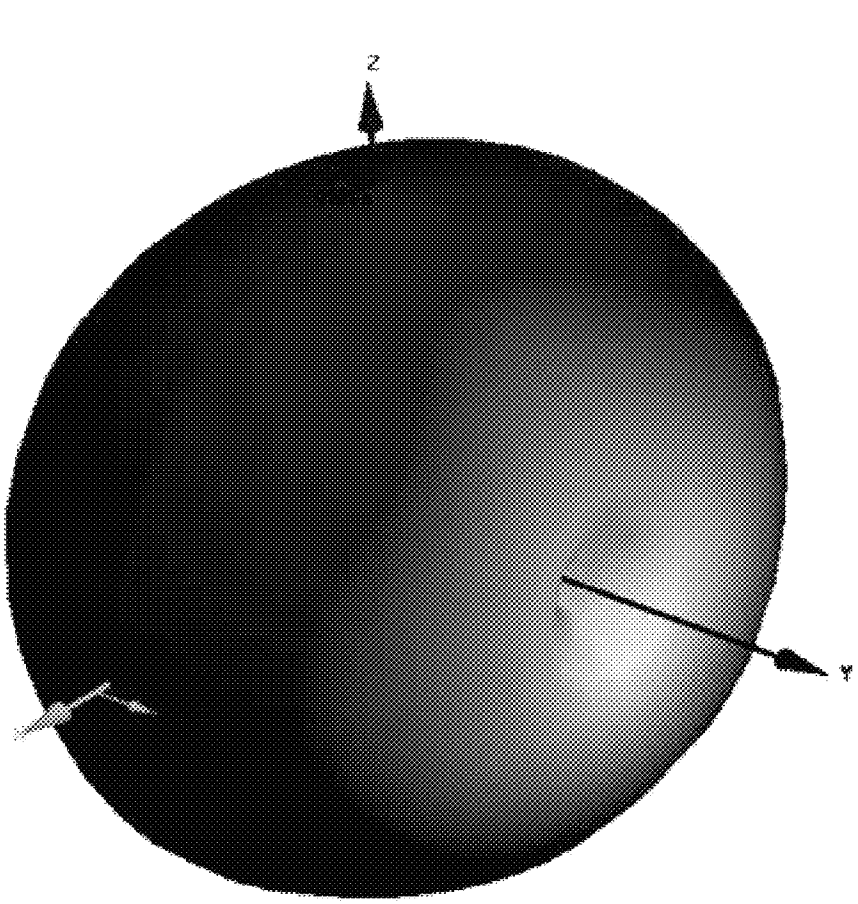
FIG. 5 is a simulation result showing the theoretical coverage of the RFID antenna of FIG. 1; and, FIG. 6 is a flow chart of a preferred embodiment of the device for assisting navigation.
Figure 5:
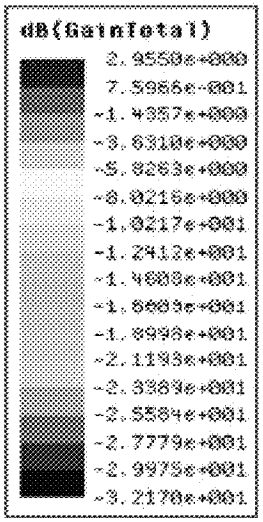

With reference to FIG. 5, a simulation result is shown for the preferred embodiment of the current invention. As the simulation result shown, the signal is radiated in a spherical manner originating from the center of the rigid PCB 307. The signal strength is higher when measured closer to the middle of the two flexible PCB 308 than away from the middle point. The simulation result as shown in FIG. 5 is evidential that the current invention is very beneficial in assisting a user with navigation. As the signal strength is amplified through the hybrid design, firstly a user does not have to use the walking stick to physically contact another RFID element as the enhanced signal strength represents a larger communication range. Such a feature can also assist a visually impaired user by allowing a higher tolerance of poorly placed walking stick and improved the reading ability of the RFID device 300 in the walking stick.

In one embodiment, the current invention may be used by a user to navigate within a space distributed with RFID tags. A user may attach a holder that includes a RFID reader to a walking assistance such as a walking stick. The user may use the RFID reader of the holder to communicate with RFID tags and at least one notification device 304 connecting with the RFID reader may generate a signal regarding information stored on the RFID tag. For example, an elderly may attach a holder containing a RFID reader to a walking stick when he/she is about to commute. The elderly may use the walking stick to assist in walking and he/she may use the RFID reader in the holder to interact with other RFID devices to perform functions that are dedicated to help those who are in need. These functions may include for example a mobile payment function where the elderly can simply walk into a turnstile and the RFID reader in the holder will interact with another RFID device in the turnstile for authentication or payment. Such a function is advantageous as the elderly may now use the turnstile structure as a second support for safer navigation around obstacles. Furthermore, as the elderlies now have dedicated turnstiles to use, the stations will have better control over the rate of users going into and out of the infrastructure and therefore the reduced immobility of an elderly is no longer a significant issue to other users of the infrastructure.

Alternatively, the user may also detach a holder that includes a RFID reader from the walking assistance for communicating with RFID tags in order to obtain or exchange information. For example, in a location where it would not be necessary to use a walking stick for assistance as there is an abundance of support available, a user may opt to remove the holder containing the RFID reader so that he/she can perform the functions of the RFID reader without the bulk of the walking stick or whatever device that it is originally attached. In one example, a user may choose to remove the RFID reader from the walking stick so that he/she may use the RFID reader for functions such as payment or simply accessing information that are stored on RFID tags where they will be inappropriate to access if the RFID reader is still attached to a walking stick.

In yet another embodiment, the user may use a device for assisting navigation that has only a communication module or having a communication module and a notification device for communicating with RFID tags in order to obtain or to exchange information. For example, in a location where it would not be appropriate to produce playback using a notification device (that may generate a rather disturbing notification), such as a library or a museum, a user can tether equipment such as a wireless headset or a smartphone to the communication device. The communication device will transmit data for the smartphone or the headset to process so as to generating meaningful information for the user's utilization.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Any reference to prior art contained herein is not to be taken as an admission that the information is common general knowledge, unless otherwise indicated.

The invention claimed is:

1. A device for assisting navigation comprising:

a body defining a middle portion having a first end and a second end, a handle portion at the first end, a holder removably mounted at the second end of the body, and a data transmitter disposed within the holder and arranged to facilitate wireless or wire transmission of navigation data, wherein the holder comprises a RFID device arranged to read, transmit, or process navigation data, wherein the RFID device comprises a hybrid antenna design that includes at least two jointed antenna structures, and wherein the at least two jointed antenna structures have different flexibilities.

2. The device for assisting navigation of claim 1 wherein the holder further comprises a power source and a notification device.

3. The device for assisting navigation of claim 2 wherein the RFID device is disposed in the holder along with the power source and at least one notification device.

4. The device for assisting navigation of claim 1 wherein the at least two jointed antenna structures comprises at least one solid antenna structure and at least one flexible antenna structure connected with the at least one solid antenna structure.

5. The device for assisting navigation of claim 4 wherein the at least one solid antenna structure includes a rigid printed circuit board and the at least one flexible antenna structure includes a flexible printed circuit board wherein the rigid printed circuit board is coupled with the flexible printed circuit board on each end of the rigid printed circuit board.

6. The device for assisting navigation of claim 2 wherein the power source is a battery, a power socket or a self-sustained power unit.

7. The device for assisting navigation of claim 2 wherein the notification device is a haptics feedback generator, an aural feedback generator or a visual feedback generator.

8. The device for assisting navigation of claim 2 wherein the RFID device may be configured to interact with the data transmitter separately from the notification device, or wherein the RFID device may be configured to interact with both the data transmitter and the notification device.

9. The device for assisting navigation of claim 2 wherein the data transmitter may receive a different format of data than the notification device's received data.

10. The device for assisting navigation of claim 9, further comprising at least one equipment connected with the data transmitter that is capable of interpreting the different format of data external of the device for assisting navigation.

11. The device for assisting navigation of claim 1 wherein the body is an elongated hollow structure.

12. The device for assisting navigation of claim 1 wherein one of the first or second ends further comprises a mounting portion that mounts the holder with the body.

13. The device for assisting navigation of claim 12 wherein the mounting portion further comprises an attachment mechanism that connects with a portion of the holder.

14. The device for assisting navigation of claim 13 wherein the attachment mechanism is a lock having a resilient portion, a stopper portion, an engagement portion and an extension.

15. The device for assisting navigation of claim 1 wherein the handle portion is a layer of texturised material.

16. The device for assisting navigation of claim 1 wherein the handle portion further comprises a storage solution.

17. A method of navigating within a space distributed with RFID tags comprising providing an RFID reader having a hybrid antenna design that includes at least two jointed antenna structures, wherein the at least two jointed antenna structures have different flexibilities, removably attaching the RFID reader with a walking assistance, and after the step of removably attaching, the RFID reader communicating with RFID tags and at least one notification device connecting with the RFID reader generating a signal through the at least one notification device regarding information stored on the RFID tags.

18. A method of navigating within a space distributed with RFID tags comprising providing an RFID reader having a hybrid antenna design that includes at least two jointed antenna structures, wherein the at least two jointed antenna structures have different flexibilities, removing the RFID reader from a walking assistance, after the step of removing, the RFID reader communicating with RFID tags and at least one notification device connecting with the RFID reader generating a signal through the at least one notification device regarding information stored on the RFID tags.

19. The device for assisting navigation of claim 1, wherein the holder comprises a first locking device that couples with a corresponding locking device.

20. The device for assisting navigation of claim 19, wherein the first locking device is a first hook and the corresponding locking device is a second hook that is mounted with the body through an elastic member.

* * * * *